US007168979B2

(12) United States Patent
Cassanego et al.

(10) Patent No.: US 7,168,979 B2
(45) Date of Patent: Jan. 30, 2007

(54) MICROWAVE CONNECTOR

(75) Inventors: Paul E. Cassanego, Santa Rosa, CA (US); Tan Boon Khim, Penang (MY); Michael T. Powers, Santa Rosa, CA (US); Floyd A. Bishop, Santa Rosa, CA (US); Kenneth H. Wong, Santa Rosa, CA (US); Matthew R. Richter, Santa Rosa, CA (US); Jon L. James, Sebastopol, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 62 days.

(21) Appl. No.: 10/913,680

(22) Filed: Aug. 5, 2004

(65) Prior Publication Data

US 2006/0030208 A1 Feb. 9, 2006

(51) Int. Cl.
*H01R 9/05* (2006.01)

(52) U.S. Cl. ..... 439/578; 439/935; 174/152 GM

(58) Field of Classification Search ..... 439/578, 439/935; 174/152 GM
See application file for complete search history.

(56) References Cited

U.S. PATENT DOCUMENTS 3,731,378 A * 5/1973 Toma et al. ..... 29/879
4,035,054 A 7/1977 Lattanzi
4,174,145 A * 11/1979 Oeschger et al. ..... 439/589
4,360,245 A 11/1982 Nikitas
4,431,255 A 2/1984 Banning
4,556,271 A 12/1985 Hubbard
4,662,703 A 5/1987 Forney, Jr. et al.
4,669,805 A 6/1987 Kosugi et al.
4,720,271 A 1/1988 Grange
4,841,101 A * 6/1989 Pollock ..... 174/152 GM
4,967,703 A * 11/1990 Donnez ..... 123/45 R
4,984,990 A * 1/1991 Lindahl ..... 439/63
5,267,684 A * 12/1993 Catheline et al. ..... 228/262.1
5,298,683 A * 3/1994 Taylor ..... 174/152 GM
5,563,562 A * 10/1996 Szwec ..... 333/260
5,576,675 A 11/1996 Oldfield
5,797,765 A * 8/1998 Barnett et al. ..... 439/63
6,031,710 A * 2/2000 Wolf et al. ..... 361/302
6,071,144 A 6/2000 Tang
6,604,949 B2 * 8/2003 Oldfield ..... 439/63
6,666,725 B2 12/2003 Botka et al.
6,918,617 B2 * 7/2005 Nordquist et al. ..... 285/289.1
2004/0038587 A1 * 2/2004 Yeung et al. ..... 439/581

* cited by examiner

*Primary Examiner*—Gary F. Paumen
*Assistant Examiner*—Larisa Tsukerman

(57) ABSTRACT

A coaxial connector including an outer conductor, a glass to metal seal (GMS) assembly, and a center conductor, is disclosed. The outer conductor has a tubular shape and defines longitudinal axis. Here, the center conductor and the GMS assembly are coupled before they are placed within the outer conductor. When the GMS assembly is coaxially placed within the outer conductor, the GMS assembly and the outer conductor define a variable gap enclosure. Fusing agent such as solder is placed within the variable gap enclosure. A bead is inserted into the outer conductor surrounding the center conductor and engaging the center conductor at a circumferential slot. The slide-on dielectric bead provides support for the center conductor and maintains the center conductor's position within the outer conductor and its characteristic impedance throughout.

5 Claims, 6 Drawing Sheets

MICROWAVE CONNECTOR

BACKGROUND

The present invention relates generally to coaxial connectors for connecting, and more particularly, to coaxial connectors for use at relatively high frequencies.

Coaxial connectors are used as means to transmit electrical signals from one electronic device to another electronic device, from the electronic device to a coaxial cable, or from a coaxial cable to another electronic device. Often, hermetically sealed coaxial connectors are needed to minimize adverse effects of environmental factors such as humidity to the electronic device that the connector is connected to and thus to the electrical signals carried by the device. This is especially true for relatively high frequency signals such as microwave signals.

FIG. 1A illustrates a perspective exploded view of a prior art connector 10 and FIG. 1B illustrates a cutaway side view of the connector 10. The connector 10 includes an outer conductor 12 (also referred to as a barrel) having generally a cylindrical tube shape running along a longitudinal axis 13 and a subassembly 11. The connector 10 has an external end 14 and a connection end 16 opposite the external end 14. The external end 14 defines an outer conductor reference plane 15 illustrated by reference plane line 15.

The outer conductor 12 houses the subassembly 11. The subassembly 11 includes a center conductor 18, a sleeve 24 of conductive material, and a spacer bead 17 of insulator material. The center conductor includes a solid portion 18*a* and a fingered portion 18*b*. For convenience the center conductor portions 18*a* and 18*b* of the center conductor are collectively referred to as the center conductor 18. A glass to metal seal (GMS) assembly 22 includes a center pin 20 surrounded by glass seal 23 and a conductive annular ring 27. The subassembly 11 runs coaxially with the axis 13 of the outer conductor 12. The center pin 20 extends beyond the connection end 16 to allow the center pin 20 to mate with a device or a circuit.

The center conductor 18 extends to and ends proximal to the outer conductor reference plane 15, the end of the center conductor 18 is illustrated by line 19 in FIG. 1. Distance 21 between the outer conductor reference plane 15 and the end of the center conductor 18 is called pin depth 21. Pin depth tolerance is specified by a connector standard. For example, it is common to require the pin depth 21 to be less than 0.05 mm to meet the standard. In addition, there are performance advantages to maintaining a consistent near zero pin depth 21.

The connector 10 is typically manufactured by first assembling the subassembly 11. Then, the subassembly 11 is inserted into the outer conductor 12 until the spacer bead 17 is stopped at a step 26 defined by the outer conductor 12. Next, the pin depth 21 is measured. If the pin depth 21 is outside the desired specification tolerance, the connector 10 is disassembled and reassembled either with a different subassembly 11 or with a shim 25 to adjust the pin depth 21 to achieve the desirable pin depth 21 value. These steps (measure-disassemble-reassemble) may be repeated until the desired pin depth 21 is realized. It would be desirable to minimize or eliminate repetition of these time consuming and costly steps. An alternative is to allow a large variation (greater tolerance) in pin depth 21; however, electrical performance suffers if the pin depth 21 varies over a large range of values.

Accordingly, there remains a need for an improved connector that overcomes or alleviates these problems.

SUMMARY

The need is met by the present invention. In one embodiment of the present invention, a coaxial connector includes an outer conductor, a glass to metal seal (GMS) assembly, and a center conductor. The outer conductor has a cylindrical tubular shape and defines a longitudinal axis. The outer conductor and the GMS assembly define a variable gap enclosure. The center conductor is positioned coaxially within the outer conductor. The center conductor and also coupled to the GMS assembly such that movement of the GMS assembly moves the center conductor. Within the variable gap enclosure is fusing agent that joins the outer conductor with the GMS assembly.

In another embodiment of the present invention, a coaxial connector includes an outer conductor, a center conductor, and a slide-on dielectric bead. The center conductor is positioned within the outer conductor. The slide-on dielectric bead surrounds a portion of the center conductor and provides mechanical support for the center conductor.

In yet another embodiment of the present invention, a method of manufacturing a coaxial connector is disclosed. To manufacturing the coaxial connector, an outer conductor is fabricated and a glass to metal seal (GMS) assembly is assembled. A portion of the outer conductor defines a reference plane. A center conductor is coupled with the GMS assembly. Then, the center conductor is placed within the outer conductor such that variable gap enclosure is defined between the outer conductor and the GMS assembly. Finally, the GMS assembly and the outer conductor are fused under coaxial pressure to align the center conductor with the reference plane.

Other aspects and advantages of the present invention will become apparent from the following detailed description, taken in conjunction with the accompanying drawings, illustrating by way of example the principles of the invention.

DETAILED DESCRIPTION

Figure 1A:
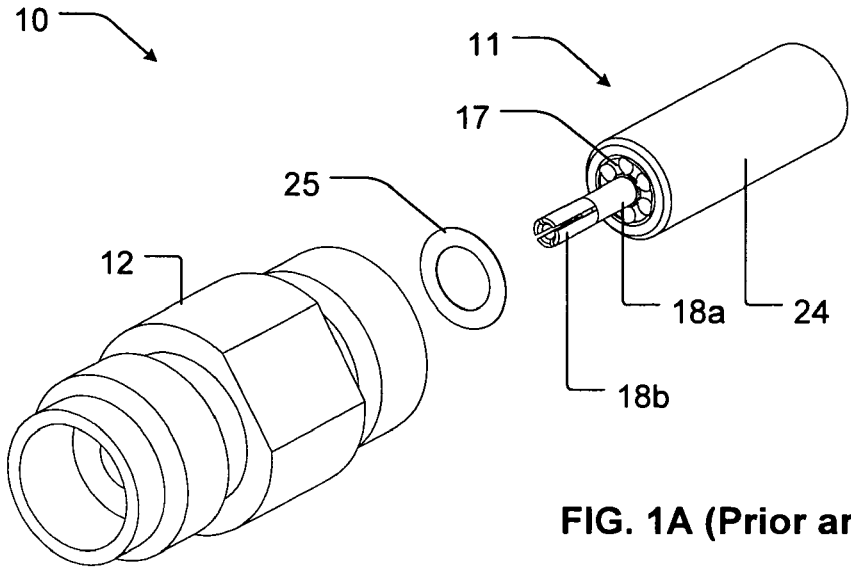
FIG. 1A (Prior art)
FIG. 1A illustrates a perspective exploded view of a prior art connector.
Figure 1B:
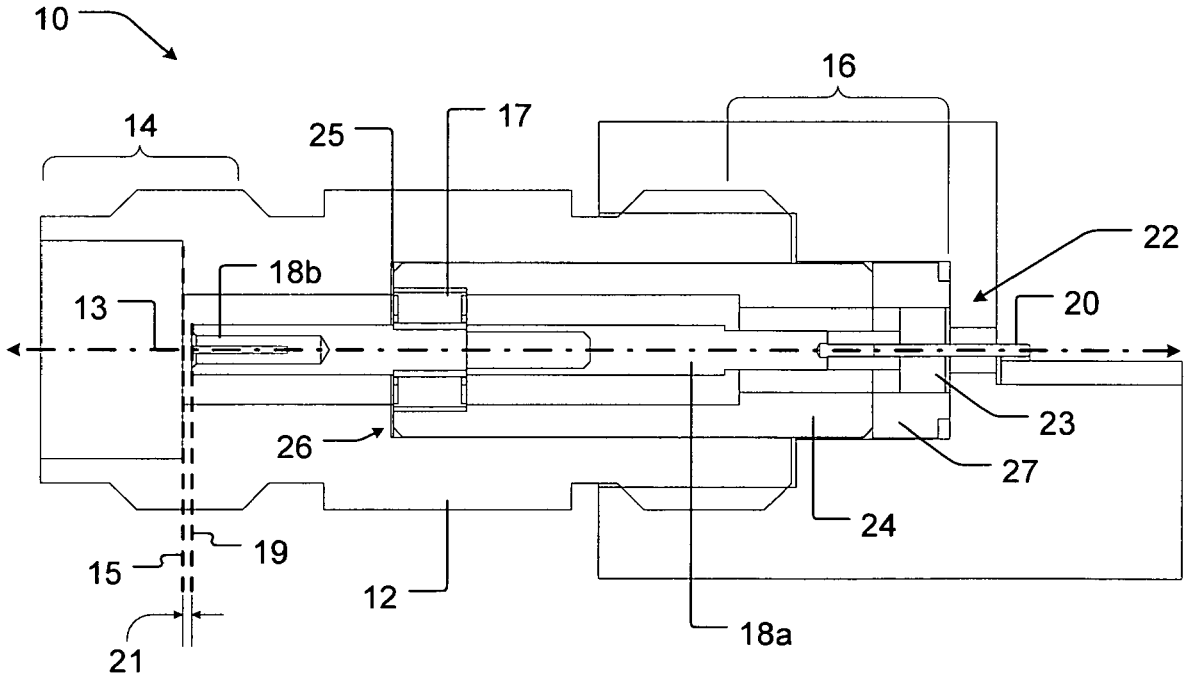
FIG. 1B (Prior art)
FIG. 1B illustrates a cutaway side view of the connector of FIG. 1A.

The present invention will now be described with reference to the FIGS. 1A through 4, which illustrate various embodiments of the present invention. In the Figures, some sizes of structures or portions may be exaggerated relative to sizes of other structures or portions for illustrative purposes and, thus, are provided to illustrate the general structures of the present invention. Furthermore, various aspects of the present invention are described with reference to a structure or a portion positioned "above" or "over" relative to other structures, portions, or both. As will be appreciated by those of skill in the art, relative terms and phrases such as "above" or "over" are used herein to describe one structure's or portion's relationship to another structure or portion as illustrated in the Figures. It will be understood that such relative terms are intended to encompass different orientations of the device in addition to the orientation depicted in the Figures. For example, if the device in the Figures is turned over, rotated, or both, the structure or the portion described as "above" or "over" other structures or portions would now be oriented "below" or "under" the other structures or portions. Like numbers refer to like elements throughout.

As shown in the Figures for the purposes of illustration, embodiments of the present invention are exemplified by a coaxial connector including an outer conductor, a glass to metal seal (GMS) assembly, and a center conductor. The outer conductor has a tubular shape and defines longitudinal axis. Here, the center conductor and the GMS assembly are coupled before they are mounted within the outer conductor. When the GMS assembly (coupled with the center pin and the center conductor) is coaxially placed within the outer conductor, the GMS assembly and the outer conductor define a variable gap enclosure. Fusing agent such as solder is placed within the variable gap enclosure.

To attach the GMS assembly with coaxial connector, the fusing agent is heated while axial pressure is applied to the GMS assembly against the outer conductor so as to control the longitudinal movement of the GMS assembly. Since the fusing agent is malleable when heated, the attachment step allows for a precise longitudinal alignment of the center conductor within the outer conductor. Accordingly, the desired pin depth can be achieved in one step, avoiding the costly and repetitive steps of measure-disassemble-shim-reassemble as explained above.

Then, a novel slide-on dielectric bead is inserted into the outer conductor, the slide-on dielectric bead surrounding the center conductor and engaging the center conductor at a circumferential slot on the center conductor. The slide-on dielectric bead provides support for the center conductor and maintains the center conductor's coaxial position within the outer conductor. The slide-on dielectric bead is made of semi-rigid plastic material. Much of the material for the slide-on dielectric bead is removed to reduce the effective dielectric constant of the slide-on dielectric bead. Accordingly, the material, the geometry of the dielectric bead, and the diameter of the center conductor are designed to match the characteristic impedance of the connector, for example 50 ohms. The novel slide on bead is designed in such a way to create a mechanical flexture, allowing the material to deform allowing it to fit within the gap between the outer conductor diameter and center conductor diameter. The bead is designed is such a way that when it snaps into the circumferential slot of the center conductor, it springs back into the shape before installation which is designed to be a specific effective dielectric constant, such that the coaxial connector maintains its desired impedance, such as 50 ohms. Angled cuts on outside edges of the bead provide non-interfering edges for its installation. At the same time, the angled cuts compensate for the center conductor's electrical characteristic change at the cut out.

Figure 2A:
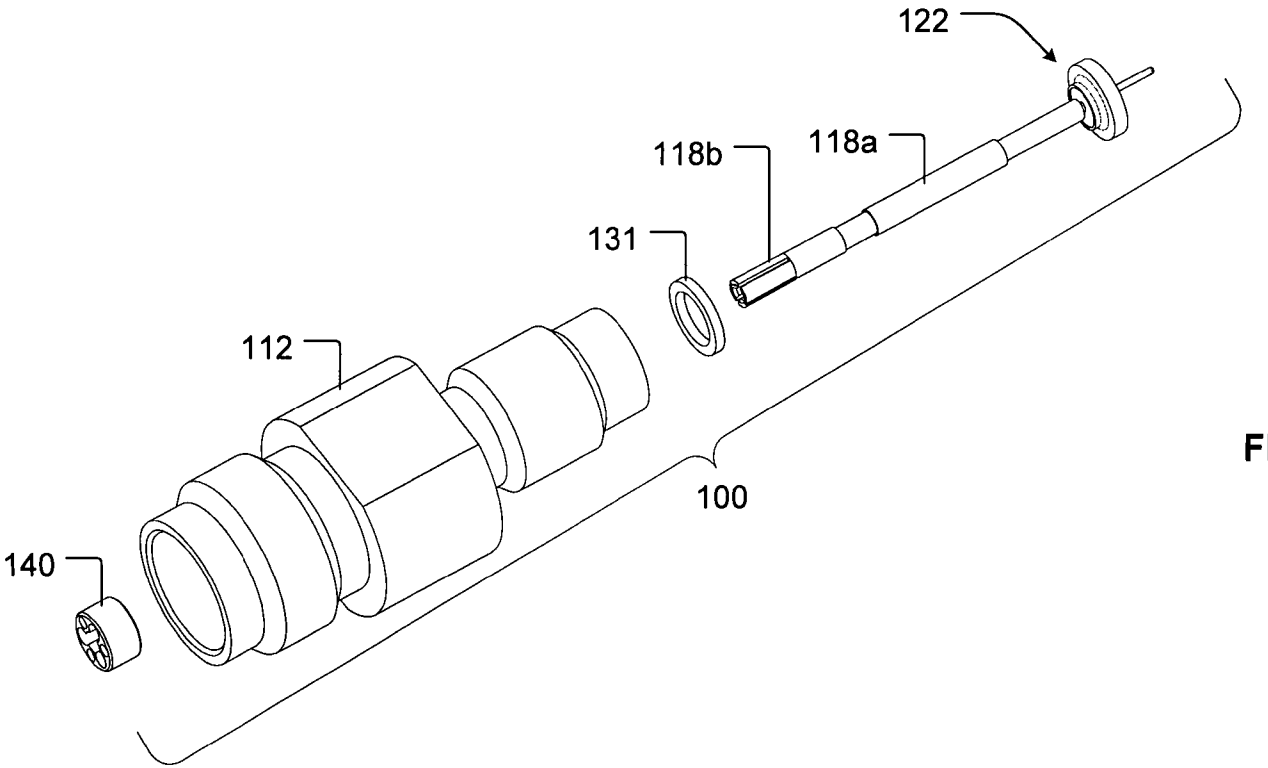
FIG. 2A is an exploded perspective view of a connector in accordance with one embodiment of the present invention.
Figure 2B:
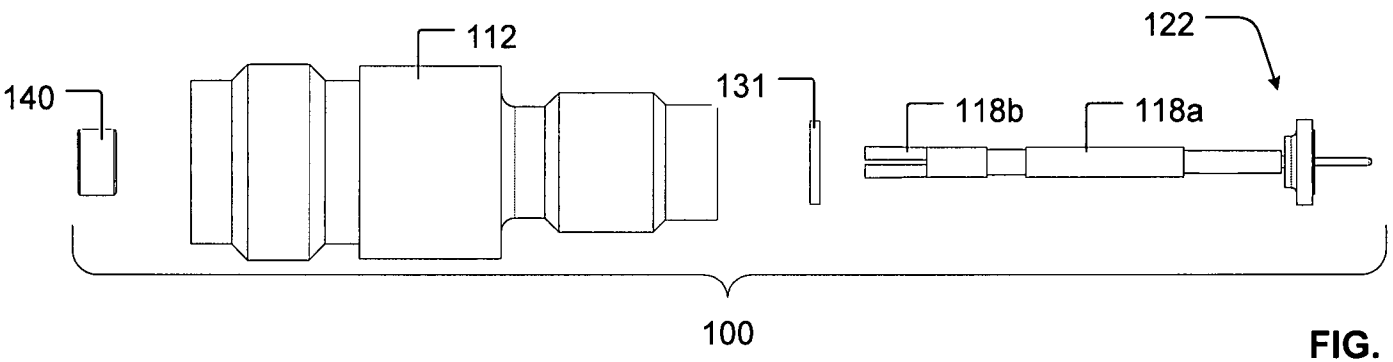
FIG. 2B is an exploded side view of the connector of FIG. 2A.
Figure 2C:
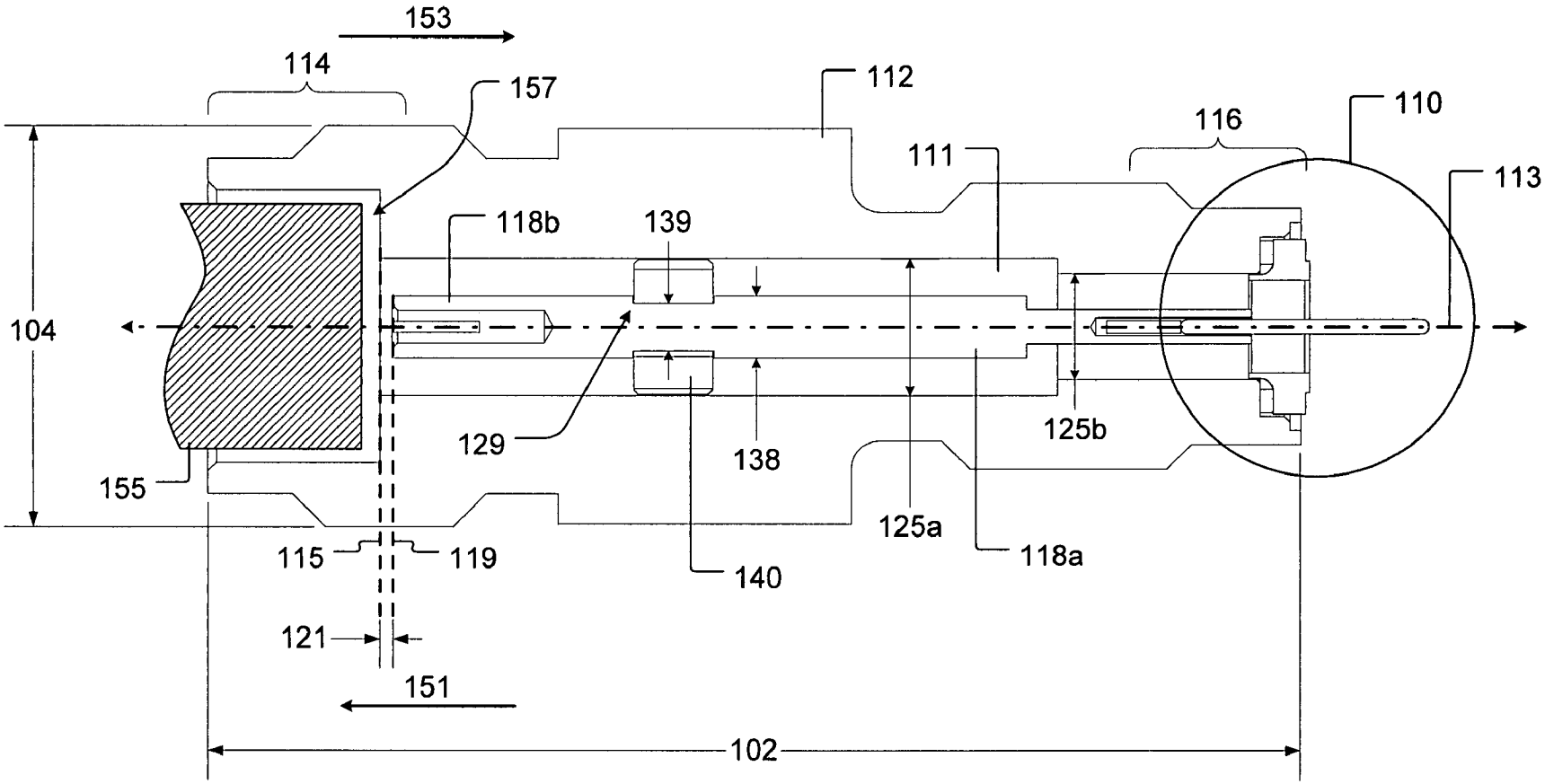
FIG. 2C is a cutaway side view of the connector of FIGS. 2A and 2B.
Figure 2D:
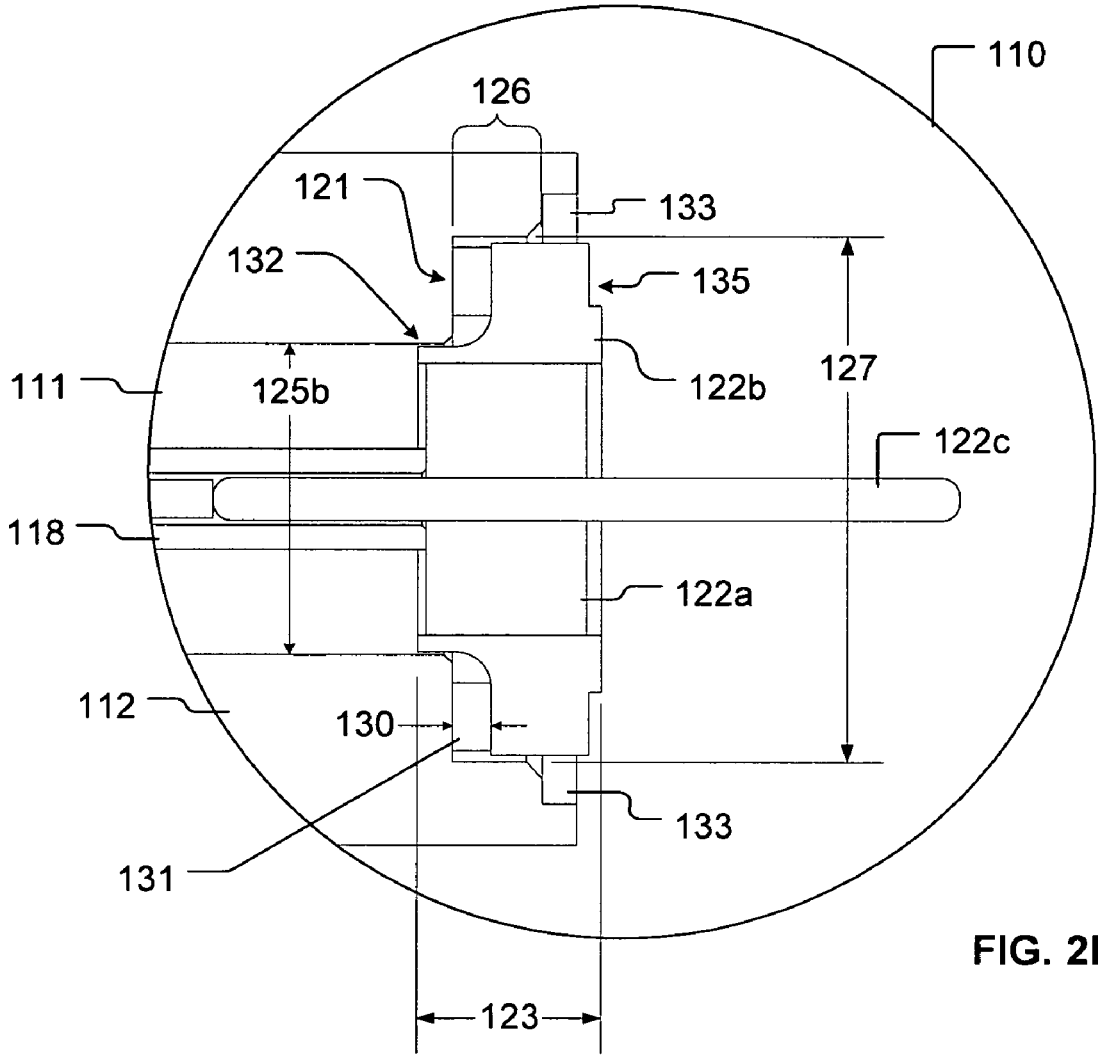
FIG. 2D is a more detailed view of a portion of the connector of FIGS. 2A, 2B, and 2C.

FIG. 2A is an exploded perspective view of a connector 100 in accordance with one embodiment of the present invention. FIG. 2B is a side view of the connector 100. FIG. 2C is a cutaway side view of the connector 100. FIG. 2D is a more detailed view of a portion 110 of the connector 100. Referring to FIGS. 2A through 2D, the connector 100 includes an outer conductor 112 and an annular glass to metal seal (GMS) assembly 122 including a glass seal 122*a*, a metal sealing ring 122*b*, and a center pin 122*c* (collectively, glass to metal seal (GMS) assembly 122).

Here, the outer conductor 112 and the GMS assembly 122 define a variable gap enclosure 130. The variable gap enclosure 130 is a gap between the outer conductor 112 and the GMS assembly 122 in the longitudinal axis 113. The variable gap enclosure 130 can be formed in many configurations one of which is illustrated in the Figures and discussed herein.

The outer conductor 112 has generally a cylindrical tube shape running along a longitudinal axis 113 and having an external end 114 and a connection end 116 opposite the external end 114. The external end 114 defines an outer conductor reference plane 115 illustrated by reference plane line 115. The outer conductor 112 has an inner diameter (a first bore) 125*a* in the order of millimeters (mm), for example, 2.4 mm. Portions of the outer conductor 112 can have different inner diameters. For example, the outer conductor 112 has a portion near the connection end, the portion having a second bore 125*b*. Size of the outer conductor 112 can vary widely depending on desired characteristics and application. In the illustrated sample embodiment, the outer conductor 112 has a length 102 in the order of millimeters or tens of millimeters (mm), for example, 20 mm and a cross sectional diameter 104 in the order of mm, for example seven mm. The outer conductor 112 is made from conductive material such as metal.

In the illustrated embodiment, a third bore portion 126 of the outer conductor 112 has a third bore 127 at its connector end 116 such that the GMS assembly 122 can be placed within the connector end 116 of the outer conductor 112. The third bore 127 is greater than the second bore 125*b* so that a step 121 results. The third bore diameter 127 can be in the order of mm, for example, 3.2 mm. The outer conductor 112 can include other features such as other portions having different bore diameters, outer mating features for the connector 100, and means for attaching the connector 100 to housing (now illustrated in the Figures). For example of the other features, the connector 112 body can be threaded at or near connector end 116 such that the connector 100 can be attached into a corresponding threaded section of the housing. The connector 100 can also be attached horizontally (as laid out in the Figures) or vertically.

The glass to metal seal (GMS) assembly 122 is attached inside the connection end 116 of the outer conductor 112. The metal sealing ring 122*b* can be made of material that has favorable or matching coefficient of thermal expansion (CTE) with glass such as, for example, Kovar®. The use of material having matching CTE minimizes shear stress on the glass 122*a*, preventing it from cracking. The GMS assembly 122 has generally annular in shape and has a cross sectional diameter in the order of mm that is slightly less than the third bore 127. The GMS assembly 122 and a thickness 123 in the range of mm, for example 1.1 mm.

The connector 100 also includes a center conductor 118 housed in the outer conductor 112, the center conductor 118 connected to the center pin 122*c* of the GMS assembly 122. The center conductor 118 includes a solid center conductor portion 118*a* and a finger portion 118*b*. For convenience the center conductor portions 118*c* and 118*b* are collectively referred to as the center conductor 118. The center conductor 118 has generally a cylindrical shape with a circular cross section having center conductor diameter 138 that can be in the order of mm, for example 1.1 mm. The center conductor 118 can be soldered to the center pin 122*c*.

The center conductor 118 and the GMS assembly 122 are positioned coaxially with the axis 113 within the outer conductor 112. The center conductor 118 extends toward the external end 114 and ends proximal to the outer conductor reference plane 115. In the Figures, the end of the center conductor 118 is illustrated by line 119. The center pin 122*c* extends beyond the connection end 116 to allow the center pin 122*c* to mate with another connector, a device, or a circuit. The center conductor 118 is connected to the GMS assembly 122 via the center pin 122*c*. Thus, any movement of the GMS assembly 122 moves the center conductor 118.

The center conductor 118 and the GMS assembly 122 (connected to the center conductor 118 via the center pin 122*c*) are placed within the outer conductor 112 such that the variable gap enclosure 130 is defined. Fusing agent 131 such as solder is placed within the variable gap enclosure 130 to join the outer conductor 112 with the GMS assembly 112. Accordingly, during the manufacture of the connector 110, when the solder 131 is malleable, pin depth 121 (distance between the end 119 of the center conductor 118 and the reference plane 115) can be adjusted by applying pressure to the GMS assembly 122. The fusing 131 provides for a hermetic seal of the GMS assembly 122 with the outer conductor 112.

The fusing agent 131 joins the outer conductor 112 with the GMS assembly 122. The fusing agent 131 can be, for example, eutectic Au—Sn (Gold-Tin) solder. Filling of the variable gap enclosure 130 and fusing of the GMS assembly 122 to the outer conductor 112 results in a hermetic seal. The GMS assembly 122 further defines fusing agent overflow space 133 adapted to capture overflow of excess fusing agent 131 from the variable gap enclosure 130. The fusing agent overflow space 133 is space between the outer conductor 112 and the GMS assembly 122 and provides space for overflowing fusing agent 131 to settle into. The variable gap enclosure 130 can span a distance in the order of mm or fractions of mm, for example, 0.2 mm.

To achieve a pin depth of zero (that is, to have the end 119 of the center conductor 118 coincide with the reference plane 115), or to achieve a pin depth of a specified value, a cylindrical tool 155 (only a portion of the cylindrical tool 155 is shown) with a flat surface 157, or a stepped surface can be placed against the reference plane 115 of the external end 114 of the outer conductor 112. Then, the fusing agent 131 is melted and pressure applied to the GMS assembly 122 to push the center conductor 118 towards the cylindrical tool 155 in a first direction 151, or pressure is applied to the cylindrical tool 155 (to push the center connector 118 away in a second direction 153), or both.

In the illustrated embodiment, most of the annular GMS assembly 122 has a diameter slightly less than the second bore 127 such that the GMS assembly 122 fits into the second bore portion 126 of the outer conductor 112. To improve the fit of the GMS assembly 122 with the outer conductor 112, the annular GMS assembly 122 can include a narrower portion 132 where its diameter is slightly less than the third bore 125*b* such that the narrower portion 132 is inserted into the outer conductor beyond the third bore portion 126 of the outer conductor 112. The GMS assembly 122 further includes a clearance step 135 that allows clearance for fusing agent for connection with another connection device or apparatus.

Figure 3A:
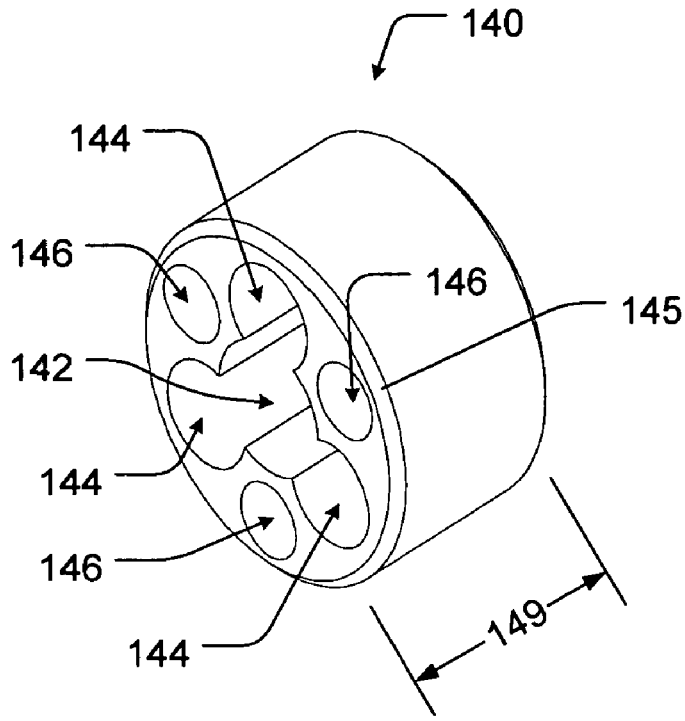
FIG. 3A is a perspective view of a component of the connector of FIGS. 2A, 2B, and 2C.
Figure 3B:
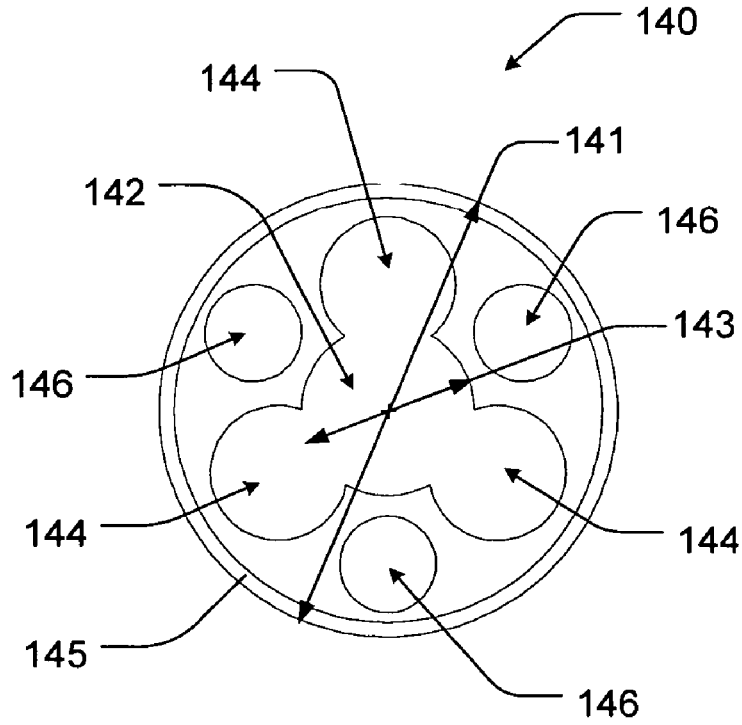
FIG. 3B is a front view of the component of FIG. 3A.

A slide-on dielectric bead 140 surrounds a portion of the center conductor 118 provides mechanical support of the center conductor 118 as well as to separate the center conductor 118 from the outer conductor 112. The slide-on dielectric bead 140 supports the center conductor 118 in the radial direction. The slide-on dielectric bead is illustrated in more detail by FIGS. 3A and 3B. The center conductor 118 defines a circumferential slot 129 adapted to engage the slide-on dielectric bead 140, the circumferential slot 129 portion of the center conductor 118 having a circular cross section having circumferential slot diameter 139 that is less than the center conductor diameter 138. The circumferential slot diameter 139 can be in the order of mm, for example 0.8 mm. FIG. 3A is a perspective view of the slide-on dielectric bead 140 of the connector of FIGS. 2A and 2B and FIG. 3B is a front view of the slide-on dielectric bead 140 of FIG. 3A. But for the slide-on dielectric bead 140, most of the space 111 between the outer conductor 112 and the center conductor 118 is air having an effective dielectric value of close to unity.

Referring to FIGS. 2A, 3A, and 3B, the slide-on dielectric bead 140, in the illustrated embodiment, has a circular disc shape and is made of semi-rigid plastic material having some flexibility. The flexibility is needed during insertion of the slide-on dielectric bead 140 into the outer conductor 112. The slide-on dielectric bead 140 has a bead diameter 141 that is same as the first bore 125 of the outer conductor 112 such that it has a snug fit within the outer conductor 112 and has a thickness 149 in the order of mm, for example 1.4 mm.

The slide-on dielectric bead 140 defines several holes one of which is clearance hole substantially at its center, the clearance hole 142 having generally circular shape with clearance hole diameter 143 that is same as the circumferential slot diameter 139. The clearance hole 142 is adapted to accept the center conductor 118. Since the slide-on dielectric bead 140 needs to be inserted in the outer conductor 112 after the center connector 118 is in place, and since the clearance hole diameter 143 is slightly less than the center conductor diameter 138, portions of the slide-on dielectric bead 140 around the clearance hole 142 needs to flex until the slide-on dielectric bead reaches the circumferential slot 129.

To increase the flexibility of the slide-on dielectric bead 140 near the clearance hole 142, the slide-on dielectric bead 140 defines multiple support holes 144 intersecting the clearance hole 142. The support holes 144 remove material around the clearance hole 142 thus increasing flexibility, or mechanical flexure, of the slide-on dielectric bead 140 around the clearance hole 142. The illustrated support holes 144 are circular; however, it can be implemented in other shapes. For example, the support holes 144 can be implemented as slots intersecting the clearance hole 142.

Geometry and material of the dielectric bead 140 and the diameter of the center conductor 139 are designed to match the characteristic impedance of the connector, for example 50 ohms. The novel slide-on bead 140 is designed in such a way to create a mechanical flexture, allowing the material to deform during installation allowing it to fit within the gap between the outer conductor diameter (at its first bore 125) and center conductor diameter 138. The bead 140 is designed is such a way that when it snaps into the center conductor's circumferential slot 129, it springs back into the shape before installation which is designed to be a specific effective dielectric constant, such that the coaxial connector's characteristic impedance is maintained at its desired value, such as 50 ohms.

Further, the slide-on dielectric bead 140 defines angled edges 145, or chamfers 145, providing leading edges for easier installation and decreased dielectric constant of the slide-on dielectric bead. The chamfers 145 provide an easy entry wedge during installation of the dielectric bead 140 within the outer conductor. 112. Further, removal of the material of the dielectric bead 140 to form the chamfers 145 contributes to the compensation of parasitic capacitance of the center conductor's circumferential slot 129 to maintain the desired characteristic impedance of the coax connector 100.

Further, the slide-on dielectric bead 140 defines multiple relief holes 146 whereby material of the slide-on dielectric bead 140 is removed thus decreasing effective dielectric constant of said slide-on dielectric bead 140 thereby allowing mostly air dielectric transition between the outer conductor 112 and the center conductor 118. This is advantageous for high frequency electrical performance. Sizes of the support holes 144 and the relief holes 146 can vary widely within the dimensions of the slide-on dielectric bead 140.

Figure 4:
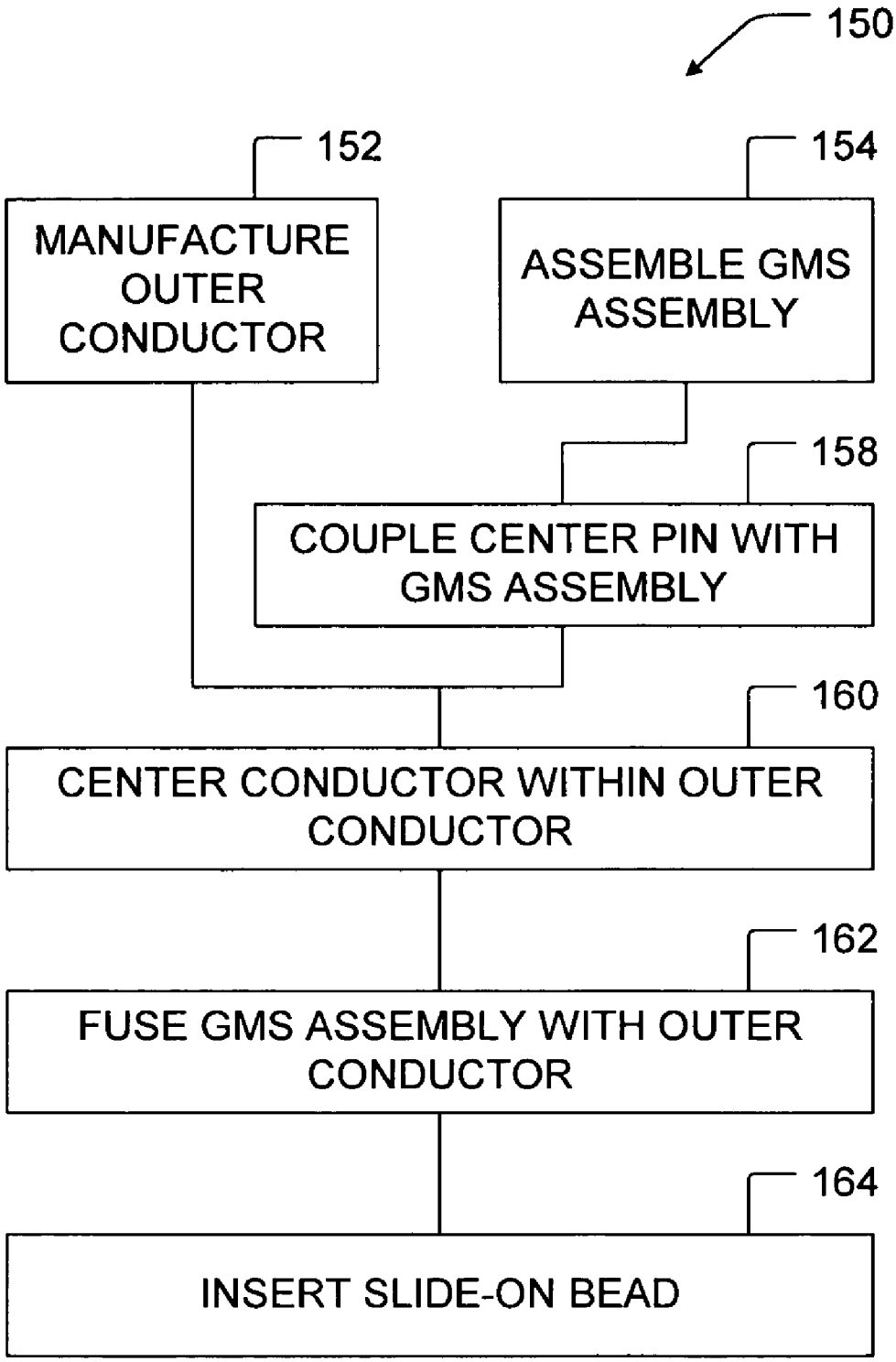
FIG. 4 is a flowchart illustrating connector assembly steps in accordance with another embodiment of the present invention.

A method of manufacturing the coaxial connector 100 is outlined by a flowchart 150 of FIG. 4. Referring to FIGS. 4 and 2C, first, the components of the connector 100 are fabricated including the outer conductor 112 and the GMS assembly 122. Steps 152 and 154. The GMS assembly 122 includes the glass seal 122*a*, the metal sealing ring 122*b*, and the center pin 122*c* (collectively, glass to metal seal (GMS) assembly 122). The center conductor 118 is coupled with the GMS assembly 122. Step 158. Next, the center conductor 118 is placed within the outer conductor 112. Step 160. This step also places the GMS assembly 122 within the second bore portion 126 of the outer conductor 112. Then, the GMS assembly 122 and the outer conductor 112 are fused under coaxial pressure to align the center conductor 118 with the reference plane 115. Step 162. Since the center conductor 118 is aligned with the reference plane 115, repetition of the steps to measure-disassemble-shim-reassemble required in the prior art designs is eliminated. Finally, the slide-on dielectric bead 140 is inserted into the outer conductor 112, the slide-on dielectric bead 140 surrounding the center conductor 118 and engaging the circumferential slot 129 on the center conductor 118. Step 164.

The connector 100, thusly manufactured, can be used to transmit or receive signals having high frequency signals, for example, having frequencies of GHz, tens of GHz, or hundreds of GHz.

From the foregoing, it will be apparent that the present invention is novel and offers advantages over the current art. Although specific embodiments of the invention are described and illustrated above, the invention is not to be limited to the specific forms or arrangements of parts so described and illustrated. The invention is limited by the claims that follow.

What is claimed is:

1. A coaxial connector comprising:

an outer conductor;

a center conductor positioned within said outer conductor; and a slide-on dielectric bead surrounding a portion of the center conductor, said slide-on dielectric bead providing mechanical support for said center conductor;

wherein said slide-on dielectric bead defines a clearance hole adapted to accept the center conductor; and wherein said slide-on dielectric bead defines multiple support holes intersecting the clearance hole whereby material of said slide-on dielectric bead is removed around the clearance hole thus increasing flexibility of said slide-on dielectric bead around the clearance hole.

2. A coaxial connector comprising:

an outer conductor;

a center conductor positioned within said outer conductor; and a slide-on dielectric bead surrounding a portion of the center conductor, said slide-on dielectric bead providing mechanical support for said center conductor;

wherein the center conductor has generally cylindrical shape having a center conductor diameter;

wherein said slide-on dielectric bead defines a clearance hole having generally disc shape having a clearance hole diameter; and wherein said center conductor diameter is greater than said clearance hole diameter.

3. A method of manufacturing a coaxial connector, said method comprising:

fabricating an outer conductor, the outer conductor defining a reference plane;

assembling a glass to metal seal (GMS) assembly;

coupling a center conductor with the GMS assembly;

placing the center conductor within the outer conductor such that variable gap enclosure is defined between the outer conductor and the GMS assembly;

fusing the GMS assembly and the outer conductor under coaxial pressure to align the center conductor with the reference plane; and inserting a slide-on dielectric bead into the outer conductor, the slide-on dielectric bead surrounding the center conductor, the slide-on dielectric bead defining multiple support holes intersecting a clearance hole whereby.

4. The method recited in claim 3 further comprising a step of inserting a slide-on dielectric bead into the outer conductor, the slide-on dielectric bead engaging a circumferential slot on the center conductor.

5. The method recited in claim 3 wherein the outer conductor and the GMS assembly define fusing agent overflow space adapted to capture fusing agent overflow.

* * * * *